US011953280B1

(12) United States Patent
Blake et al.

(10) Patent No.: US 11,953,280 B1
(45) Date of Patent: Apr. 9, 2024

(54) RIFLE REST FOR A VERTICAL SUPPORT POST AND ASSOCIATED METHODS

(71) Applicants: Robert B Blake, Gold Creek, MT (US); Alan Wanderer, Bozeman, MT (US)

(72) Inventors: Robert B Blake, Gold Creek, MT (US); Alan Wanderer, Bozeman, MT (US)

(73) Assignee: Road Runner Rifle Rest, LLC, Bozeman, MT (US)

( * ) Notice: Subject to any disclaimer, the term of this patent is extended or adjusted under 35 U.S.C. 154(b) by 0 days.

(21) Appl. No.: 18/345,808

(22) Filed: Jun. 30, 2023

(51) Int. Cl.
*F41A 23/06* (2006.01)

(52) U.S. Cl.
CPC ..... *F41A 23/06* (2013.01)

(58) Field of Classification Search
USPC ..... 42/94
See application file for complete search history.

(56) References Cited

U.S. PATENT DOCUMENTS 3,007,581 A * 11/1961 Moore ..... A01M 31/00 135/69
3,584,821 A * 6/1971 Glebe ..... F41A 23/04 248/156
5,491,920 A * 2/1996 McCullers ..... F41A 23/00 42/94
5,913,667 A * 6/1999 Smilee ..... F41A 23/06 42/94
6,935,065 B1 * 8/2005 Oliver ..... F41A 23/04 248/161
7,493,719 B2 * 2/2009 Lackey ..... F41A 23/04 211/64
7,784,212 B1 * 8/2010 Chilton ..... F41A 23/16 42/94
8,215,325 B2 * 7/2012 Montanti ..... A61H 3/00 135/65
2022/0026013 A1 * 1/2022 Liao ..... F16M 11/245
2023/0096179 A1 * 3/2023 Hutton, Jr. ..... A45B 1/00 135/66

* cited by examiner

*Primary Examiner* — Reginald S Tillman, Jr.
(74) *Attorney, Agent, or Firm* — Collaborative IP; Paul Ditmyer

(57) ABSTRACT

The rifle rest is for use with a vertical support post. The rifle rest includes a body including a collar configured to substantially surround the vertical support post, and at least one tightening mechanism coupled to the collar and configured to tighten the collar and position the body at a selected height on the vertical support post. A pivotable arm, defining a rifle rest platform, is pivotally coupled to the body and configured to be pivoted between a stored position adjacent the vertical support post and a deployed position extending away from the vertical support post. The pivotable arm is coupled to the body via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

18 Claims, 6 Drawing Sheets

RIFLE REST FOR A VERTICAL SUPPORT POST AND ASSOCIATED METHODS

FIELD

The present invention relates in general to the field of shooting and hunting, and more particularly, to an accessory that provides a stationary rest on a vertical support for a gun/rifle or other equipment such as a camera, range finder or spotting scope.

BACKGROUND

Achieving stability while shooting is a critical aspect of marksmanship, directly impacting accuracy and precision. To address this challenge, various technological advancements have led to the development of innovative stable shooting platforms.

Bipods have long been a popular choice for providing stability in shooting platforms. Modern bipods have undergone significant advancements, offering improved features for shooters. Lightweight and adjustable, they attach to the rifle's fore-end and provide a stable base by resting on two extendable legs. Many bipods feature quick-deploy mechanisms, allowing shooters to rapidly set up a stable shooting platform in various conditions. Additionally, some bipods incorporate swivel capabilities, enabling shooters to track moving targets smoothly.

Tripods have emerged as an effective solution for creating stable shooting platforms. Designed with three extendable legs and a central mounting system, tripods offer enhanced stability and versatility. Shooters can adjust the tripod's height, leg angle, and positioning to adapt to different shooting positions and terrains. Some advanced tripod systems also include leveling mechanisms to ensure a perfectly horizontal shooting platform. Furthermore, tripods often feature pan-tilt heads, enabling controlled and precise movements for tracking targets.

Modular shooting supports have gained popularity due to their adaptability and stability. These systems consist of a central support structure, often made of lightweight materials such as carbon fiber or aluminum, and interchangeable accessories. Shooters can customize their shooting platform by attaching various accessories like cradles, bags, or supports to achieve the desired stability. Modular shooting supports provide flexibility, allowing shooters to tailor their setups to specific shooting scenarios and firearms.

Articulating stocks have revolutionized stability by allowing shooters to adjust their rifle's interface with their body. These stocks incorporate adjustable components that adapt to the shooter's shoulder, cheek weld, and grip, providing a personalized fit. By ensuring proper alignment, articulating stocks minimize shooter-induced movements and increase stability. Some models even feature built-in recoil reduction mechanisms, further enhancing stability and mitigating muzzle rise.

Chassis systems have transformed the stability and accuracy of rifles. These platforms replace traditional wooden or polymer stocks with rigid and precision-machined metal structures. Chassis systems provide a solid foundation for the rifle, offering improved stability and reducing flex during firing. They often incorporate features like adjustable length of pull, comb height, and accessory mounting points, allowing shooters to achieve a customized and stable shooting platform.

Emerging technologies have introduced active stability systems that employ electronic or mechanical mechanisms to counteract shooter-induced movements. These systems incorporate sensors, gyroscopes, and actuators to detect and compensate for slight shifts or vibrations during shooting. By actively stabilizing the rifle, these systems enhance accuracy and reduce the impact of external factors, such as wind or body movement.

For example, US Publication 2023/0096179 to Hutton Jr. describes a fold-out accessory rest for securement to a trekking or ski pole or tripod leg in a folded-up position and then deployed by unfolding the rest for supporting a firearm, scope, camera, or other accessory. The rest includes a rest body for mounting on a pole/leg, a strap-supporting flap rotatably connected at its lower end near a lower part of the rest body, and a rest-strap rotatably connected at a proximal end near the rest-body's middle part and at a distal end to the distal end of the strap-supporting flap. The accessory includes hook-and-loop straps and a securing cap.

This background section is intended to introduce the reader to various aspects of typical technology that may be related to various aspects or embodiments of the present invention, which are described and/or claimed below. This discussion is believed to be useful in providing the reader with background information to facilitate a better understanding of the various aspects and embodiments of the present invention. Accordingly, it should be understood that these statements are to be read in light of, and not as admissions of, the prior art.

SUMMARY

An object of the present invention may be to provide a stationary rifle rest that is attachable and detachable from a vertical support post. A pivotable arm defines a rifle rest platform and pivots/rotates from the "stored position", adjacent to the post, to the "deployed position", extending laterally from the post to provide a stationary support for the rifle. The pivotable arm can then be repositioned back to its original unobtrusive stored position when not in use.

Objects and features of the invention may be provided by a rifle rest for use with a vertical support post. The rifle rest includes a body including a collar configured to substantially surround the vertical support post, and at least one tightening mechanism coupled to the collar and configured to tighten the collar and position the body at a selected height on the vertical support post. A pivotable arm, defining a rifle rest platform, is pivotally coupled to the body and configured to be pivoted between a stored position adjacent the vertical support post and a deployed position extending away from the vertical support post. The pivotable arm is coupled to the body via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

Additionally, and/or alternatively, the body comprises first and second body portions together defining the collar.

Additionally, and/or alternatively, the tightening mechanism is coupled between the first and second body portions. The tightening mechanism may comprise at least two fasteners.

Additionally, and/or alternatively, the second body portion includes an arm brace coupled to the pivotable arm. The arm brace may include an arm stop defining a pivot limit configured to limit further rotation of the pivotable arm at the deployed position while extending away from the vertical support post.

Additionally, and/or alternatively, the pivotable arm includes a stop surface corresponding to the arm stop of the arm brace and configured to engage the arm stop when the pivotable arm is pivoted to the pivot limit at the deployed position.

Another embodiment is directed to a rifle rest for use with a vertical support post. The rifle rest includes a body including a collar configured to substantially surround the vertical support post, and at least one tightening mechanism coupled to the collar and configured to tighten the collar and position the body at a selected height on the vertical support post. A pivotable arm, defining a rifle rest platform, is pivotally coupled to the body and configured to be pivoted between a stored position adjacent the vertical support post and a deployed position extending away from the vertical support post. The body includes an arm brace coupled to the pivotable arm and including an arm stop defining a pivot limit configured to limit further rotation of the pivotable arm at the deployed position while extending away from the vertical support post. The pivotable arm includes a stop surface corresponding to the arm stop of the arm brace and configured to engage the arm stop when the pivotable arm is pivoted to the pivot limit at the deployed position.

Additionally, and/or alternatively, the pivotable arm is coupled to the arm brace via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

Additionally, and/or alternatively, the body comprises first and second body portions together defining the collar.

Additionally, and/or alternatively, the tightening mechanism is coupled between the first and second body portions. The tightening mechanism may include at least two fasteners.

Additionally, and/or alternatively, the second body portion includes the arm brace coupled to the pivotable arm.

Another embodiment is directed to a method of making a rifle rest for use with a vertical support post. The method includes: providing a body including a collar configured to substantially surround the vertical support post; coupling at least one tightening mechanism to the collar and configured to tighten the collar and position the body at a selected height on the vertical support post; and coupling a pivotable arm, defining a rifle rest platform, to the body and configured to be pivoted between a stored position adjacent the vertical support post and a deployed position extending away from the vertical support post. The pivotable arm is coupled to the body via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

Additionally, and/or alternatively, the body comprises first and second body portions together defining the collar.

Additionally, and/or alternatively, the tightening mechanism is coupled between the first and second body portions. The tightening mechanism may include at least two fasteners.

Additionally, and/or alternatively, the second body portion includes an arm brace coupled to the pivotable arm. The arm brace may include an arm stop defining a pivot limit configured to limit further rotation of the pivotable arm at the deployed position while extending away from the vertical support post.

Additionally, and/or alternatively, the pivotable arm includes a stop surface corresponding to the arm stop of the arm brace and configured to engage the arm stop when the pivotable arm is pivoted to the pivot limit at the deployed position.

Another objective of the invention is to provide a lightweight rifle rest on a vertical support, thereby avoiding heavier, cumbersome and more complex rifle rests.

Still another objective is to provide a rifle rest that can be instantaneously available on the vertical support by rapidly overcoming the stationary resistance of the rifle rest from the fixed stored position to a stationary fixed deployed position.

Another objective of this invention may be to provide a stable rifle rest on a vertical support with an attachment mechanism that maintains the rifle rest at a preset fixed position. Commercial vertical supports can telescope, nest or fold so the rifle rest can be preset on a segment of the vertical support, such that when the vertical support is collapsed, or unfolded and then reextended, the rifle rest will be located at the ideal preset vertical height.

An additional objective of this invention may be to provide an attachment mechanism that allows the user to tighten the rifle rest at a preset fixed position on a vertical support, but allows loosening the attachment mechanism so that the rifle rest can be moved up or down the vertical support to a new fixed location.

Yet another objective of this invention may be to provide an attachment mechanism, such as a flip lock, that allows swiftly moving the rifle rest vertically up or down the vertical support to a desired location and then move the rifle rest from the stored to the deployed position.

Still another objective may be using the rifle rest for other applications such as setting and stabilizing a camera, monocular, binoculars or other apparatuses.

BRIEF DESCRIPTION OF THE DRAWINGS

The example embodiments are best understood from the following detailed description when read with the accompanying drawing figures. In fact, the dimensions may be arbitrarily increased or decreased for clarity of discussion. Wherever applicable and practical, like reference numerals refer to like elements.

DETAILED DESCRIPTION

Figure 1:
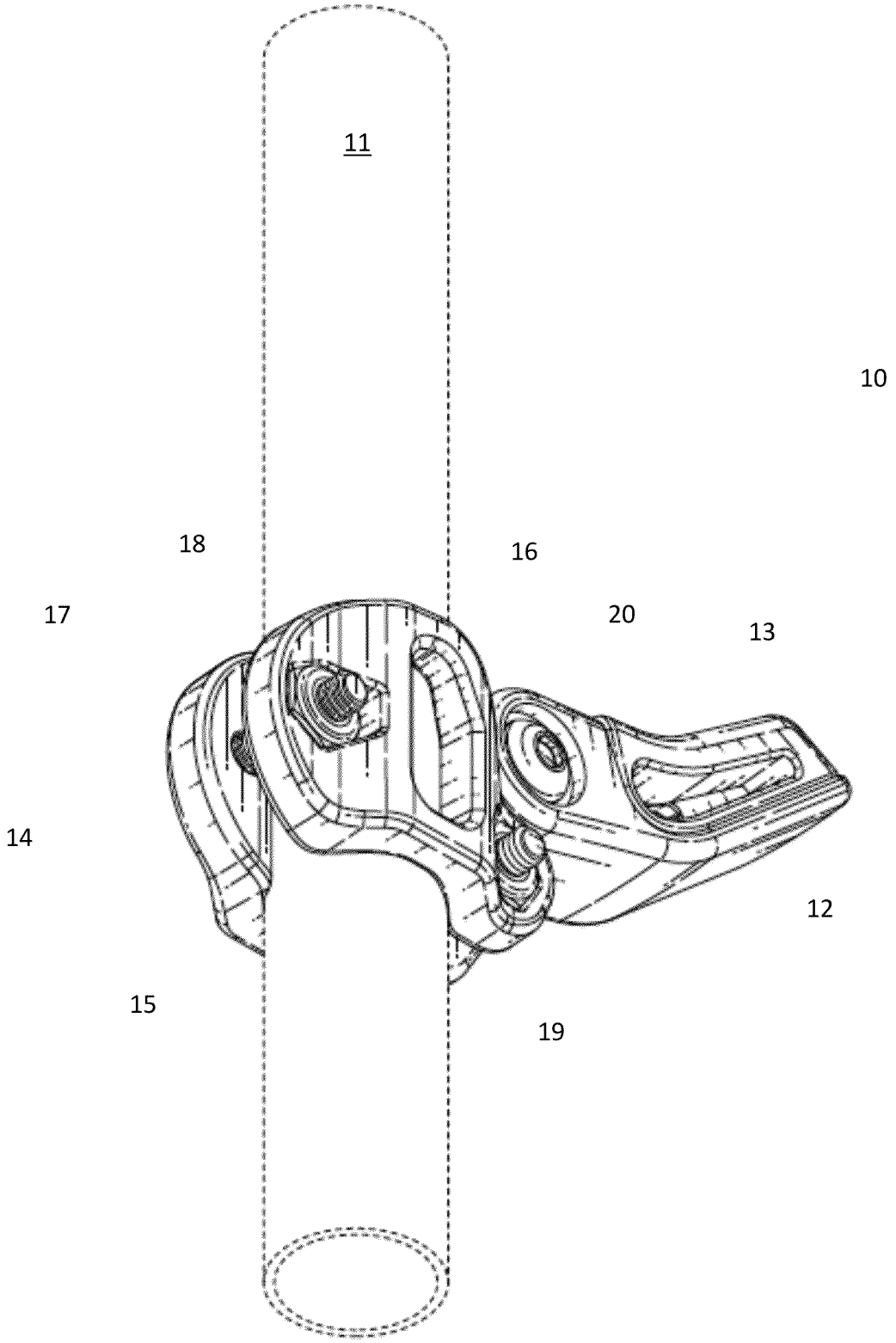
FIG. 1 is a side perspective view of a rifle rest for a vertical support post in accordance with features of the present invention.
Figure 2:
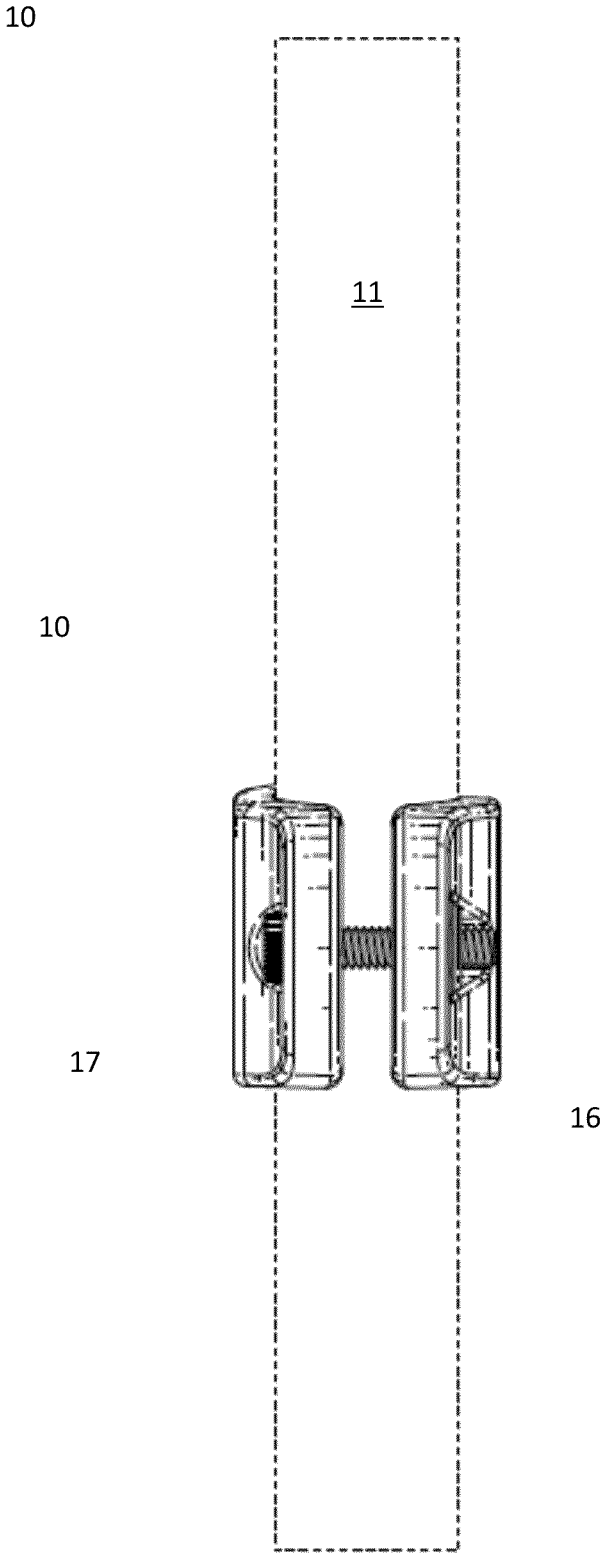
FIG. 2 is a rear view of the rifle rest for a vertical support post illustrated in FIG. 1.
Figure 3:
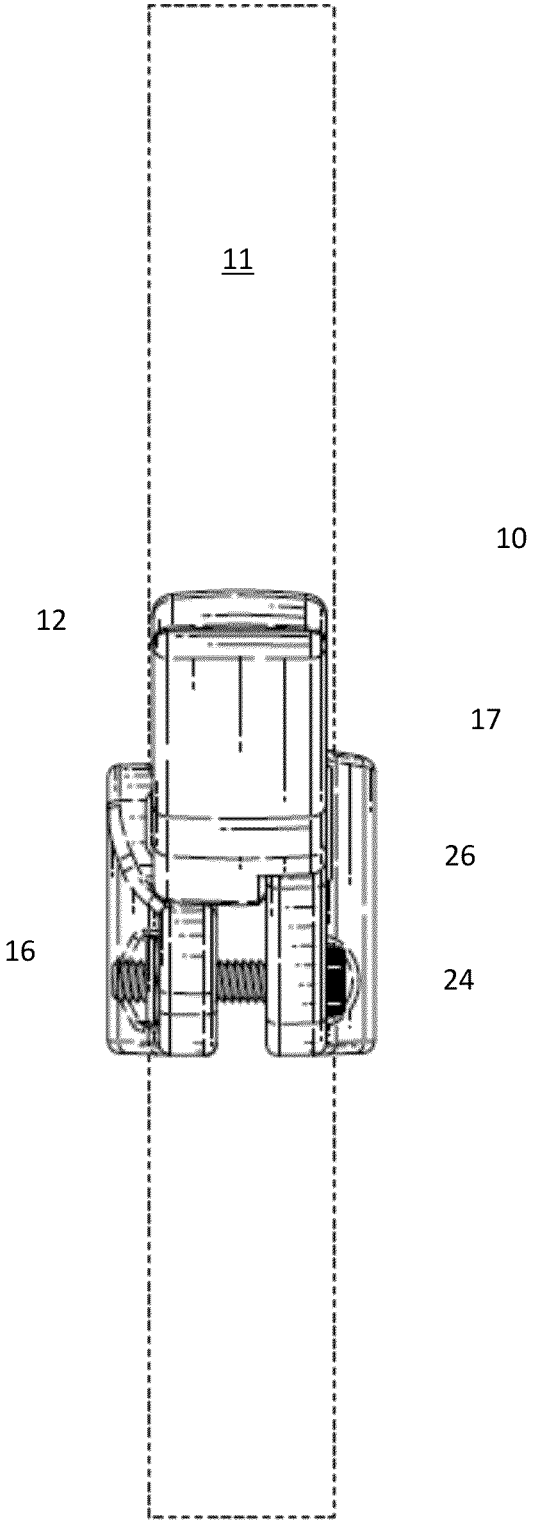
FIG. 3 is a front view of the rifle rest for a vertical support post illustrated in FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Before describing the present disclosure in detail, it is to be understood that this disclosure is not limited to parameters of the particularly exemplified systems, methods, apparatus, products, processes, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "embodiment," "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "sensor" includes one, two, or more sensors.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within the embodiment.

The headings used herein are for organizational purposes only and are not meant to be used to limit the scope of the description or the claims. To facilitate understanding, like reference numerals have been used, where possible, to designate like elements common to the figures.

Referring to FIGS. 1-8, an embodiment of a rifle rest in accordance with features of the present invention will now be described. "Rifle rest" may also be referred to as gun rest, equipment rest, or the like. Also, "vertical support post" may be defined as any vertical support including, but not limited to, a monopole, bipod, tripod, walking stick, hiking stick, and/or ski pole, for example.

A stationary rifle rest 10 is attachable and detachable from a vertical support post 11. A pivotable arm 12 defines a rifle rest platform 13 and pivots/rotates from the "stored position", adjacent to the post, to the "deployed position", extending laterally from the post 11 to provide a stationary support for equipment, e.g. a rifle. The pivotable arm 12 can then be repositioned back to its original unobtrusive stored position (e.g. FIG. 8) when not in use.

The rifle rest 10 includes a body 14 including a collar 15 configured to substantially surround the vertical support post 11. The body 14 may include first 16 and second 17 body portions together defining the collar 15. The body portions 16/17 are shown with arcuate interior surfaces that are configured to interface with the rounded exterior surface of a vertical support post 11. Other arrangements are contemplated. The body 14 may also be formed as a unitary body with a flexible hinge, for example.

A tightening mechanism 18/19 is coupled to the collar 15 and configured to tighten the collar and position the body 14 at a selected height on the vertical support post 11. The tightening mechanism 18/19 is coupled between the first and second body portions. The tightening mechanism is illustrated as two fasteners, e.g. bolts and associated nuts. Other tightening mechanisms are contemplated, such as flip locks, wing nuts or any other mechanism that can readily and reliably tighten the collar 15 around the vertical support post 11.

As discussed, the pivotable arm 12, defining the rifle rest platform 13, is pivotally coupled, via coupler 20, defining an axis of rotation, to the body 14 and configured to be pivoted between a stored position (FIG. 8) adjacent the vertical support post 11 and a deployed position (e.g. FIGS. 1, 4 and 5) extending away from the vertical support post 11. The pivotable arm 12 is coupled to the body via the coupler 20 which imparts a pivotal resistance that keeps the pivotable arm 12 selectively secured in either the stored position and/or the deployed position, respectively, until a user overcomes the pivotable resistance and pivots the pivotable arm 12 to selectively store the pivotable arm or deploy the pivotable arm 12.

The pivotal resistance may be defined as the friction between the interfacing surfaces of the pivotable arm 12 and the second body portion 17. The pivotal resistance may be varied via coupler 20. For example, a user may tighten or loosen the coupler 20 thereby increasing or decreasing the pivotal resistance. Other mechanisms are contemplated for creating the desired pivotal resistance. For example, corresponding notched interfacing surfaces or a biasing member may be utilized to create the desired pivotal resistance.

Figure 4:
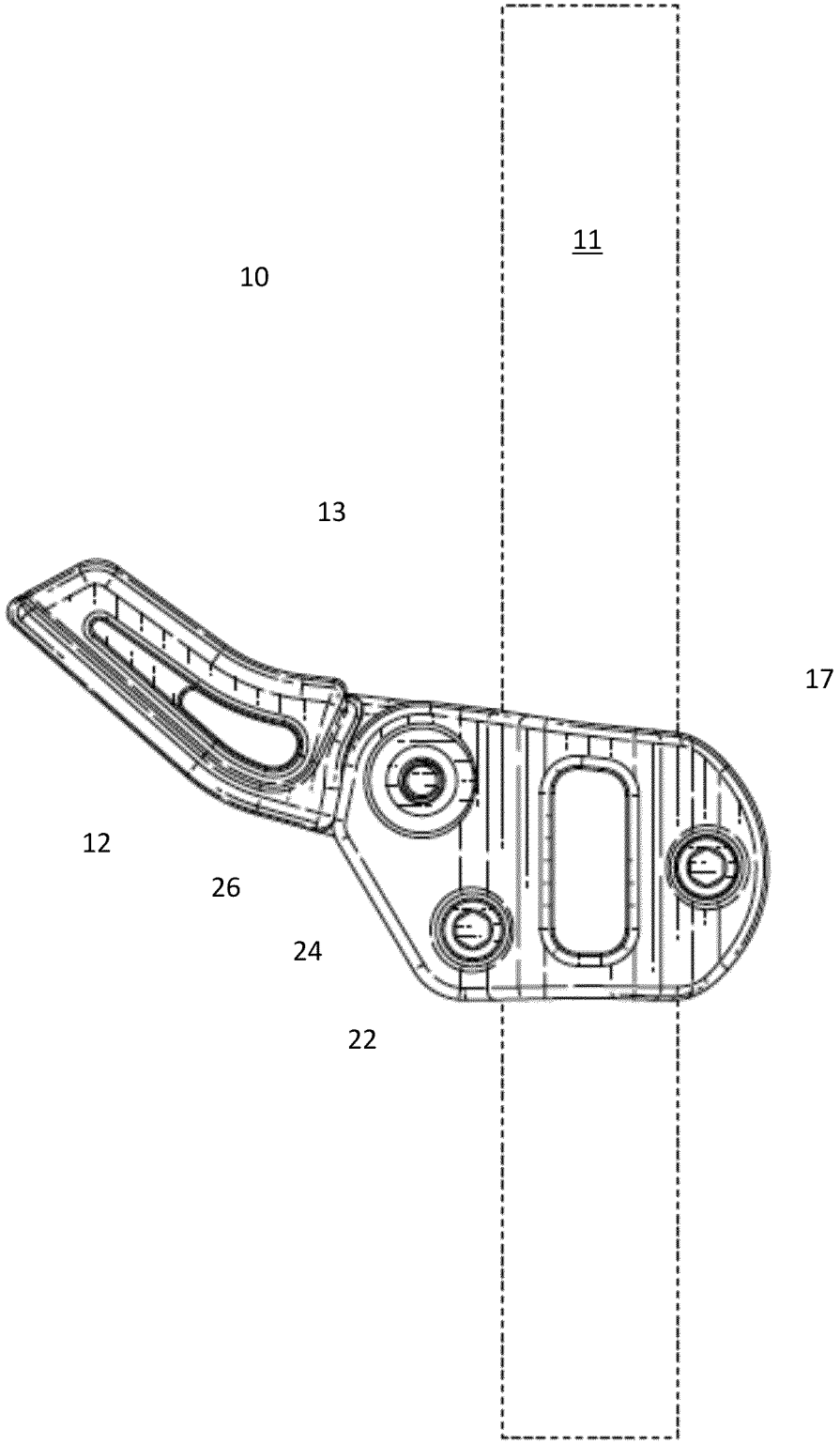
FIG. 4 is a right side view of the rifle rest for a vertical support post illustrated in FIG. 1.
Figure 5:
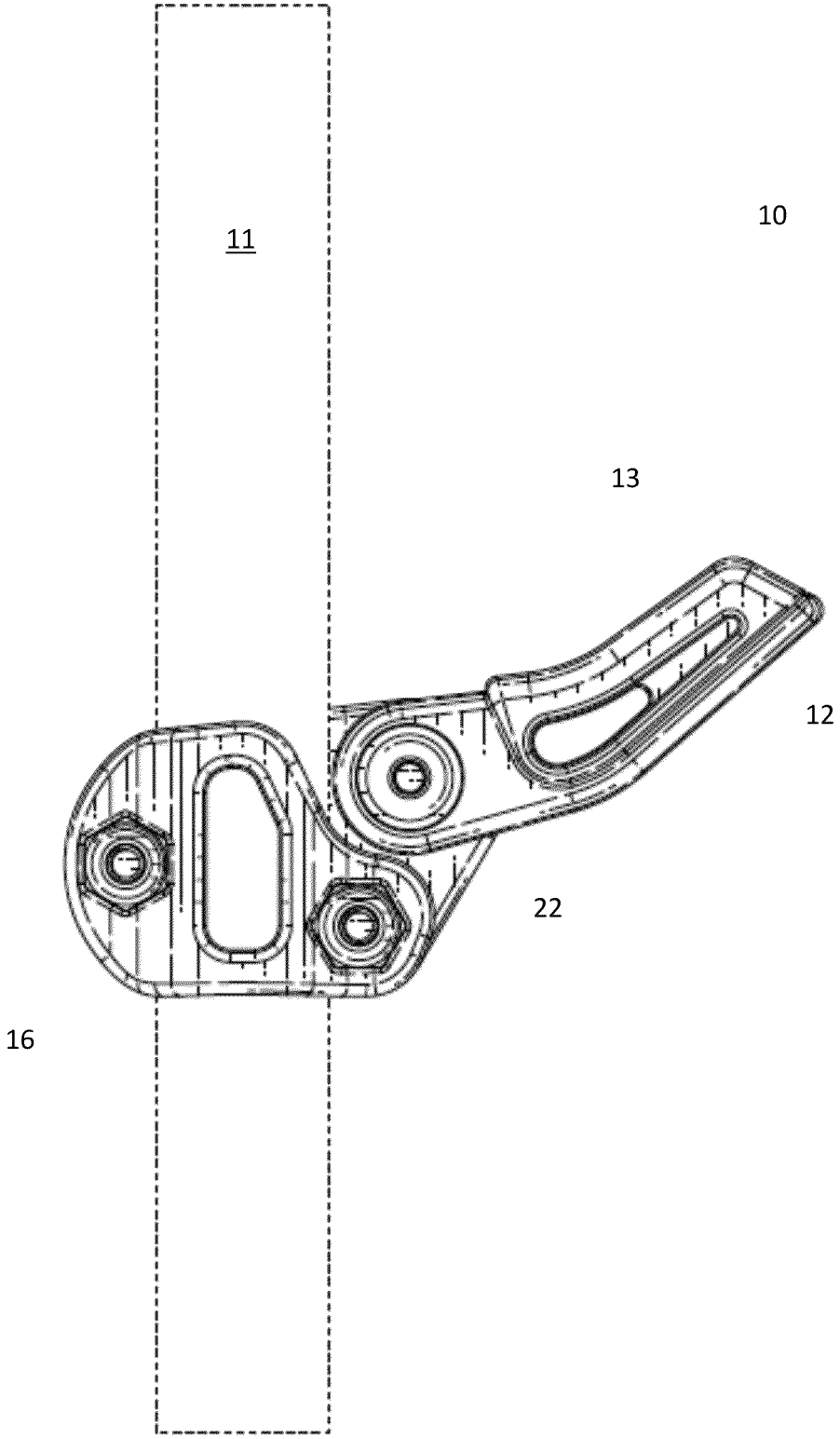
FIG. 5 is a left side view of the rifle rest for a vertical support post illustrated in FIG. 1.
Figure 6:
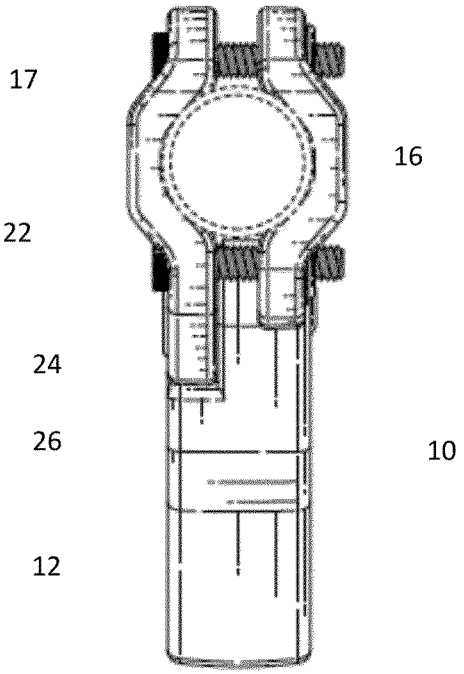
FIG. 6 is a bottom view of the rifle rest for a vertical support post illustrated in FIG. 1.
Figure 7:
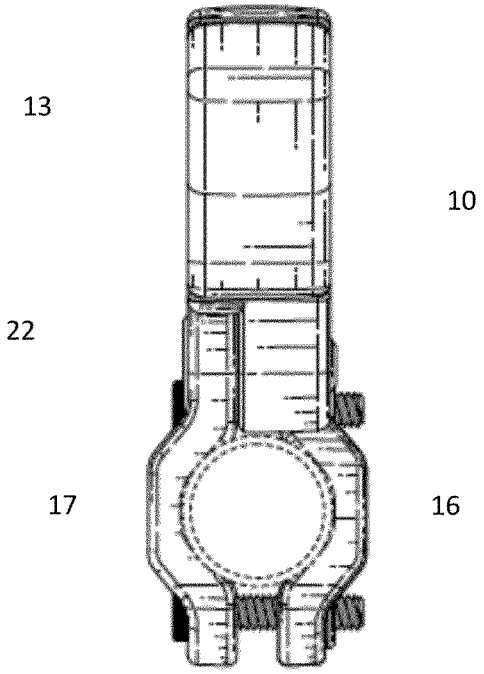
FIG. 7 is a top view of the rifle rest for a vertical support post illustrated in FIG. 1.
Figure 8:
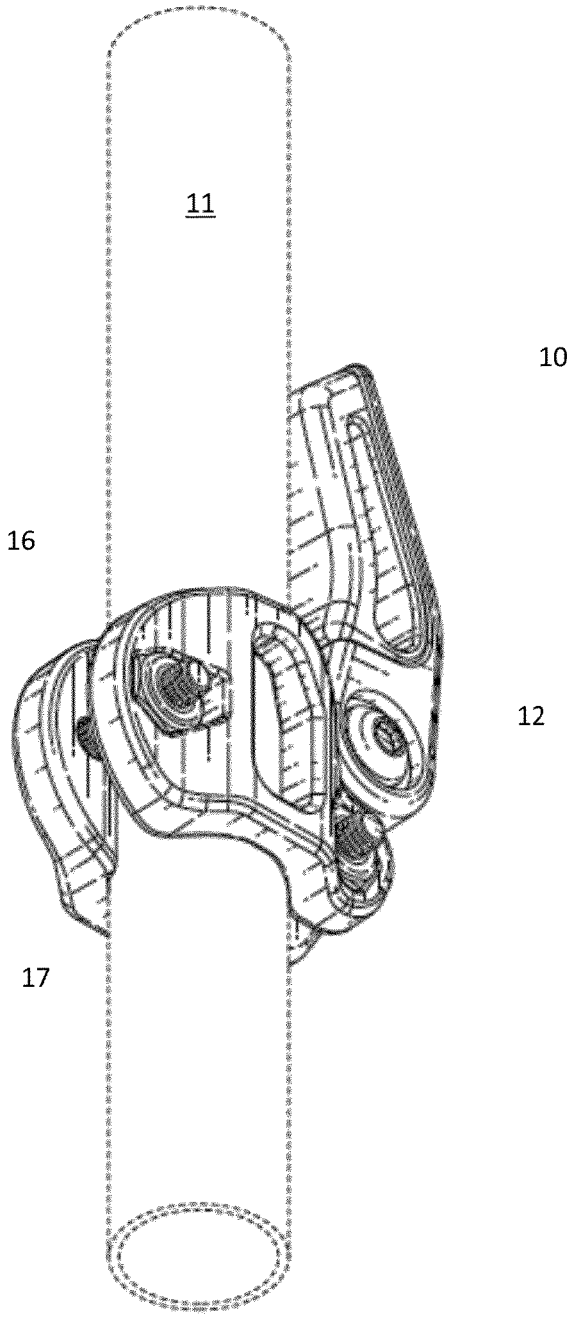
FIG. 8 is another side perspective view of the rifle rest of FIG. 1 but in a stored or retracted position.

As perhaps is best illustrated in FIGS. 4-6, the second body portion 17 includes an arm brace 22 coupled to the pivotable arm 12. The arm brace 22 may include an arm stop 24 defining a pivot limit configured to limit further rotation of the pivotable arm 12 at the deployed position while extending away from the vertical support post 11. Correspondingly, the pivotable arm 12 includes a stop surface 26 corresponding to the arm stop 24 of the arm brace 22 and configured to engage the arm stop 24 when the pivotable arm 12 is pivoted to the pivot limit at the deployed position.

Figure 9:
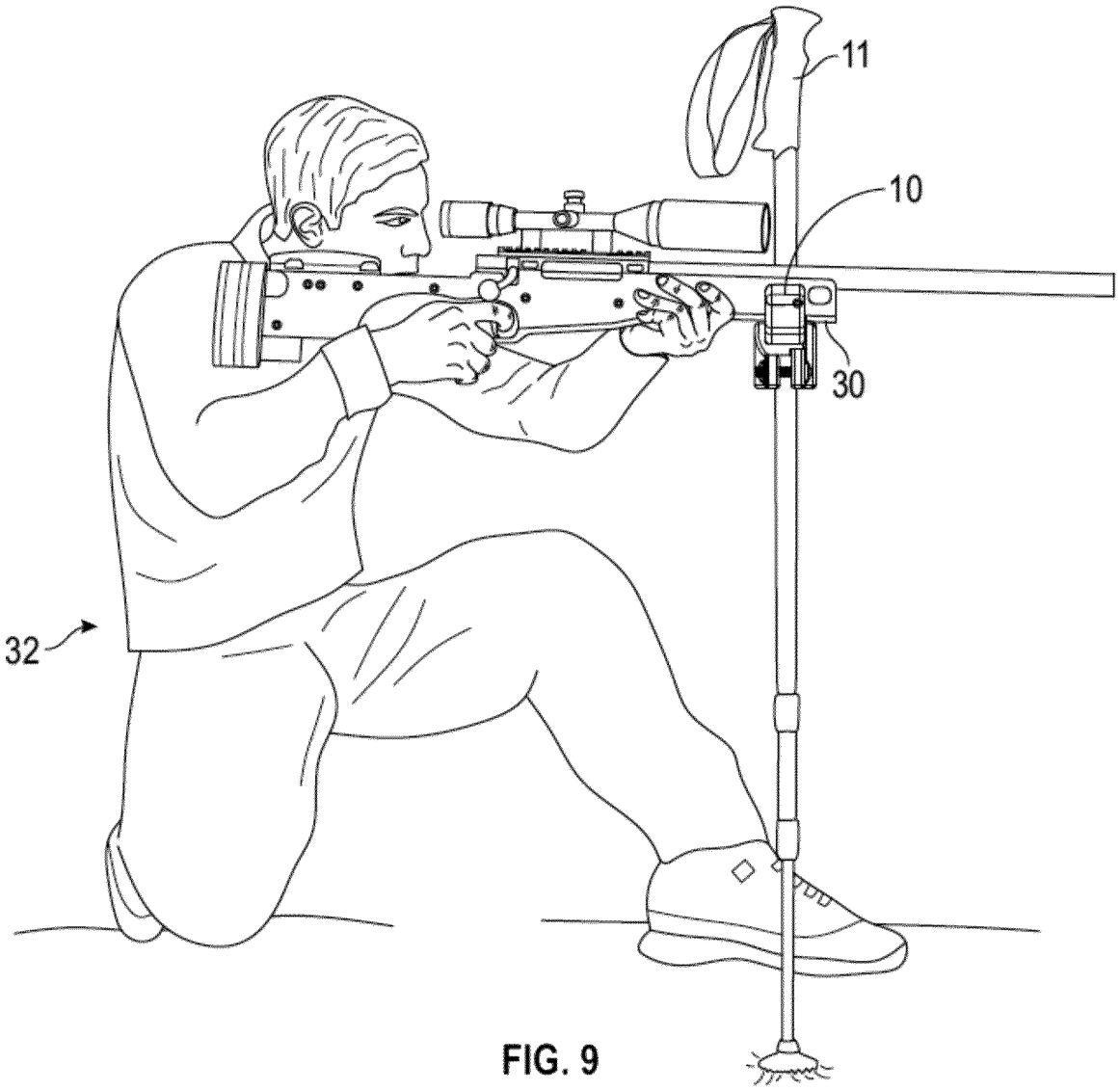
FIG. 9 is a perspective view illustrating the rifle rest attached to a vertical support post (e.g. a hiking pole) and supporting a rifle.

FIG. 9 is a perspective view illustrating the rifle rest 10 attached to a vertical support post 11 (e.g. a hiking pole) and supporting a rifle 30 of a user 32.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof.

Many other ramifications and variations are possible within the teachings of the various embodiments.

While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the eventual claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the eventual claims and their legal equivalents, and not by the examples given.

The invention claimed is:

1. A rifle rest for use with a vertical support post, the rifle rest comprising:

a body comprising first and second body portions, each including a respective aperture, and defining a collar configured to substantially surround the vertical support post;

at least one tightening mechanism coupled between the first and second body portions, extending within the respective apertures therein, and configured to tighten the collar and position the body at a selected height on the vertical support post; and a pivotable arm, defining a rifle rest platform, pivotally coupled to the second body portion having an axis of rotation therethrough and configured to be pivoted between a stored position adjacent the vertical support post and a deployed position extending away from the vertical support post;

wherein the pivotable arm is coupled to the second body portion via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

2. The rifle rest according to claim 1, wherein the pivotable arm includes a contoured upper surface, and when the pivotable arm is in the deployed position, the contoured upper surface defines the rifle rest platform in a space between the pivotable arm and the vertical support post.

3. The rifle rest according to claim 1, wherein the tightening mechanism comprises at least two fasteners.

4. The rifle rest according to claim 1, wherein the second body portion includes an arm brace coupled to the pivotable arm.

5. The rifle rest according to claim 4, wherein the arm brace includes an arm stop defining a pivot limit configured to limit further rotation of the pivotable arm at the deployed position while extending away from the vertical support post.

6. The rifle rest according to claim 5, wherein the pivotable arm includes a stop surface corresponding to the arm stop of the arm brace and configured to engage the arm stop when the pivotable arm is pivoted to the pivot limit at the deployed position.

7. A rifle rest for use with a vertical support post, the rifle rest comprising:

a body including a collar configured to substantially surround the vertical support post;

at least one tightening mechanism coupled to the collar and configured to tighten the collar and position the body at a selected height on the vertical support post; and a pivotable arm, defining a rifle rest platform, pivotally coupled to the body and configured to be pivoted between a stored position adjacent the vertical support post and a deployed position extending away from the vertical support post;

wherein the body includes an arm brace coupled to the pivotable arm and including an arm stop defining a pivot limit configured to limit further rotation of the pivotable arm at the deployed position while extending away from the vertical support post;

wherein the pivotable arm includes a stop surface corresponding to the arm stop of the arm brace and configured to engage the arm stop when the pivotable arm is pivoted to the pivot limit at the deployed position; and wherein the pivotable arm includes a contoured upper surface, and when the pivotable arm is in the deployed position, the contoured upper surface defines the rifle rest platform in a space between the pivotable arm and the vertical support post.

8. The rifle rest according to claim 7, wherein the pivotable arm is coupled to the arm brace via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

9. The rifle rest according to claim 7, wherein the body comprises first and second body portions together defining the collar.

10. The rifle rest according to claim 9, wherein the tightening mechanism is coupled between the first and second body portions.

11. The rifle rest according to claim 10, wherein the tightening mechanism comprises at least two fasteners.

12. The rifle rest according to claim 9, wherein the first and second body portions each include a respective aperture therein, and the tightening mechanism is coupled between the first and second body portions, extending within the respective apertures therein.

13. A method of making a rifle rest for use with a vertical support post, the method comprising:

providing a body comprising first and second body portions, each including a respective aperture, and defining a collar configured to substantially surround the vertical support post;

coupling at least one tightening mechanism between the first and second body portions, extending within the respective apertures therein, and configured to tighten the collar and position the body at a selected height on the vertical support post; and coupling a pivotable arm, defining a rifle rest platform, to the second body portion having an axis of rotation therethrough and configured to be pivoted between a stored position adjacent the vertical support post and a deployed position extending away from the vertical support post;

wherein the pivotable arm is coupled to the second body portion via a pivotal resistance that keeps the pivotable arm selectively secured in the stored position and the deployed position, respectively, until a user overcomes the pivotable resistance and pivots the pivotable arm to selectively store the pivotable arm and deploy the pivotable arm.

14. The method according to claim 13, wherein the pivotable arm includes a contoured upper surface, and when the pivotable arm is in the deployed position, the contoured upper surface defines the rifle rest platform in a space between the pivotable arm and the vertical support post.

15. The method according to claim 13, wherein the tightening mechanism comprises at least two fasteners.

16. The method according to claim 13, wherein the second body portion includes an arm brace coupled to the pivotable arm.

17. The method according to claim 16, wherein the arm brace includes an arm stop defining a pivot limit configured to limit further rotation of the pivotable arm at the deployed position while extending away from the vertical support post.

18. The method according to claim 17, wherein the pivotable arm includes a stop surface corresponding to the arm stop of the arm brace and configured to engage the arm stop when the pivotable arm is pivoted to the pivot limit at the deployed position.

* * * * *